US005440374A

United States Patent [19]

Kisu

[11] Patent Number: 5,440,374

[45] Date of Patent: Aug. 8, 1995

[54] CHARGING DEVICE, IMAGE FORMING APPARATUS AND PROCESS CARTRIDGE DETACHABLY MOUNTABLE TO IMAGE FORMING APPARATUS

[75] Inventor: Hiroki Kisu, Fujisawa, Japan

[73] Assignee: Canon Kabushiki Kaisha, Tokyo, Japan

[21] Appl. No.: 312,184

[22] Filed: Sep. 26, 1994

Related U.S. Application Data

[63] Continuation of Ser. No. 988,161, Dec. 9, 1992 abandoned.

[30] Foreign Application Priority Data

May 29, 1992 [JP] Japan ..... 164225

[51] Int. Cl.[6] ..... G03G 15/02

[52] U.S. Cl. ..... 355/219; 355/210

[58] Field of Search ..... 355/219, 210, 211, 212, 355/260; 361/225, 221

[56] References Cited

U.S. PATENT DOCUMENTS

| | | | |
|---|---|---|---|
| 4,727,453 | 2/1988 | Ewing | 355/219 X |
| 4,851,960 | 7/1989 | Nakamura et al. | 361/225 |
| 5,272,506 | 12/1993 | Goto et al. | 355/219 |
| 5,331,372 | 7/1994 | Tsuda et al. | 355/210 X |

FOREIGN PATENT DOCUMENTS

| | | | |
|---|---|---|---|
| 0329366 | 8/1989 | European Pat. Off. . | |
| 0417801 | 3/1991 | European Pat. Off. . | |
| 56-91253 | 7/1981 | Japan . | |
| 56-104349 | 8/1981 | Japan . | |
| 56-165166 | 12/1981 | Japan . | |
| 63-149669 | 6/1988 | Japan . | |
| 417801 | 3/1991 | Japan | 355/219 |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

A charging device includes a movable member to be charged; a charging member contactable to the member to be charged to electrically charge the member to be charged, a voltage application means of applying an oscillating voltage between the charging member and the member to be charged; wherein $Wc/Wd<1.0$ is satisfied, where Wc is a weight of the charging member, and Wd is a weight of the member to be charged; and wherein $Vp>f/100$ (mm/sec), where Vp (mm/sec) is a moving speed of the member to be charged, and f (Hz) is a frequency of the oscillating voltage.

21 Claims, 7 Drawing Sheets

CHARGING DEVICE, IMAGE FORMING APPARATUS AND PROCESS CARTRIDGE DETACHABLY MOUNTABLE TO IMAGE FORMING APPARATUS

This application is a continuation of U.S. application Ser. No. 07/988,161, filed Dec. 9, 1992, now abandoned.

FIELD OF THE INVENTION AND RELATED ARTS

The present invention relates to a charging device having a charging member contactable to a member to be charged such as a photosensitive member, an image forming apparatus usable with the charging device and a process cartridge detachably mountable to such an image forming apparatus.

In the following description, for easy understanding of the invention, an image forming apparatus such as an electrophotographic apparatus copying machine, printer or the like or an electrostatic recording apparatus, is taken.

In an image forming apparatus such as an electrophotographic apparatus, as for the means for charging or discharging an image bearing member in the form of an electrophotographic photosensitive member, an electrostatic recording dielectric member or the like, corona dischargers having a wire electrode which is a non-contact type charging system, have mainly been used.

A corona discharger has an advantage in that it is capable of uniformly charging the member. However, it involves drawbacks that an expensive high voltage source is required, that it requires spaces due to the shield thereof and the high voltage source, that a quantity of corona production such as ozone or the like is relatively large, that additional means or mechanism are required because of the corona production, and that bulkiness and high cost are required because of the above.

Recently therefore, in place of the corona discharger, a contact type charging means is developed. In the contact type charging, a charging member (conductive member) supplied with a voltage is contacted to a member to be charged, by which the member to be charged is electrically charged to a predetermined potential of a predetermined polarity, and therefore, the voltage of the voltage source can be reduced. In addition, the quantity of the corona product such as ozone is small, and the structure is simple and the cost is low.

As for the contact type charging member, there have been proposed a roller charger using a roller (Japanese Laid-Open Patent Application No. 91253/1981), a blade type charger (Japanese Laid-Open Patent Application No. 104349/1981), a charger-cleaner type (Japanese Laid-Open Patent Application No. 165166/1981) or the like.

In a proposal in Japanese Laid-Open Patent Application No. 149669/1988 which has been assigned to the assignee of this application, an oscillating voltage (alternating voltage, that is, the voltage having a voltage level which periodically changes with time) having a peak-to-peak voltage which is not less than twice a charge starting voltage for the member to be charged when only a DC voltage is supplied to the contact type charging member, is applied between the contact type charging member and the member to be charged. This is usable for charging and discharging. This system (AC application system) is effective to provide uniform charging.

As for a problem of the contact type charging means of an AC application type, there is a vibration noise called "charging noise" attributable to an AC component of the applied charging bias to the contact type charging member.

Referring to FIGS. 11(*a*), 11(*b*) and 11(*c*) the mechanism of the charging noise production will be described.

In these figures, reference numeral 1 designates a photosensitive drum; 1*b*, conductive base layer (base member) of aluminum electrically grounded; 1*a* is a photosensitive layer formed thereon. Reference numeral 20 designates a charging roller functioning as the contact type charging member press-contacted to the surface of the photosensitive drum 1; 21 is a metal core; 22, a charging layer of electrically conductive rubber such as EPDM or the like in which carbon is dispersed.

(1) In a certain phase of an AC component of the applied oscillating voltage (Vac+Vdc) to the charging member 20, positive and negative electric charges are induced at the charging layer 22 side and at the base layer 1*b* side, respectively, as indicated by a thick solid line (a).

(2) These positive and negative electric charges attract each other, and therefore, the surface of the charging layer 22 is attracted to the photosensitive drum 1 against the elasticity of the charging layer 22 to move from the thick solid line position to the thin solid line position to the thick solid line position in the case of (b).

(3) When the AC electric field starts to reverse, the positive charge at the charging layer 22 side and the negative charge at the base layer 1*b* side, are dissipated by the newly induced respective opposite charges.

Just when the AC field switches from the positive phase to the negative phase, the positive charge at the charging layer 22 side and the negative charge at the base layer 1*b* side, are dissipated. The state of dissipation is indicated by (b).

(4) As a result, on the surface of the charging layer 22, the attracting force against the elasticity of the charging layer 22 is removed, so that it returns by the elasticity back to the thin solid line position (thick solid line position in the case of (a)) from the thick solid line position.

(5) When the AC electric field comes to the negative peak, as shown in (c), the negative and positive electric charges are induced to the charging layer 22 side and to the base layer 1*b* side, respectively. Therefore, by the attraction force between the negative and positive electric charges, the surface of the charging layer 22 is again attracted to the photosensitive drum 1 against the elasticity of the charging layer 22, so that it moves from the thick solid line position to the thin solid line position.

In this manner, corresponding to the repeated reversal of the AC electric field, the motion of the surface of the charging layer 22 to the photosensitive drum 1 against the elasticity of the charging layer and the rebound motion by the dissipation of the attracting force, results in the vibration of the charging member 22, thus beating the photosensitive drum 1. This is considered as being the cause of the charging noise.

As will be understood, the charging member 20 vibrates twice within one period of the AC voltage, and therefore, the frequency f of the AC voltage and the frequency F of the vibration of the charging member 20, are related:

$2f(Hz)=F(c/s)$

The charging noise is not limited to the case of the charging roller used as the contact charging member, and the charging noise is produced through the same mechanism when the contact type charging member is in the form of a charging blade or charging pad or the like.

SUMMARY OF THE INVENTION

Accordingly, it is a principal object of the present invention to provide a charging device, an image forming apparatus and a process cartridge in which the charging noise is reduced.

It is another object of the present invention to provide a charging device, an image forming apparatus and a process cartridge in which a member to be charged is uniformly charged.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The embodiments of the present invention will be described in conjunction with the accompanying drawings.

Figure 10:
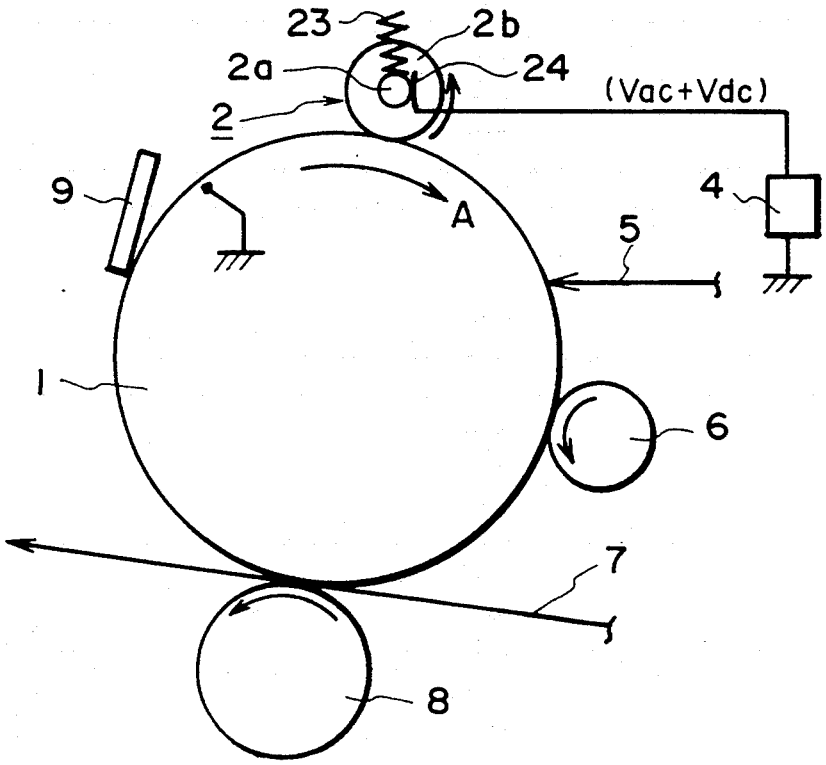
FIG. 10 is a sectional view of an example of an image forming apparatus using a contact type charging device.
Figure 11A:
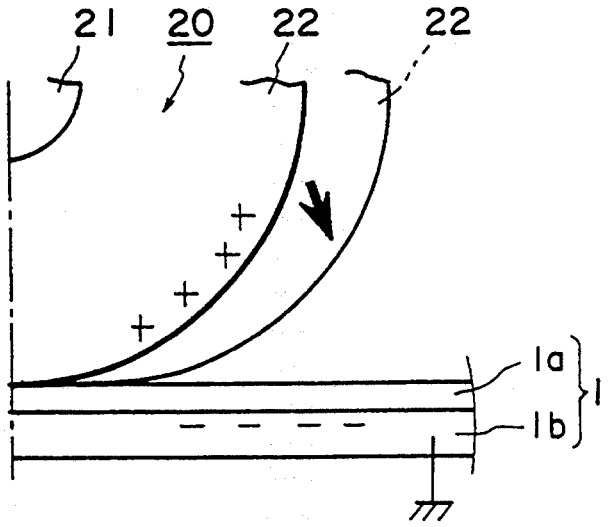
FIGS. 11(*a*), 11(*b*), and 11(*c*) illustrate a noise production mechanism.
Figure 11B:
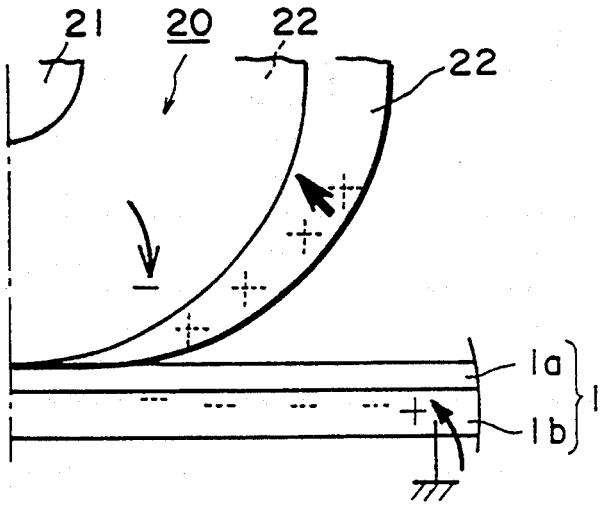
Figure 11C:
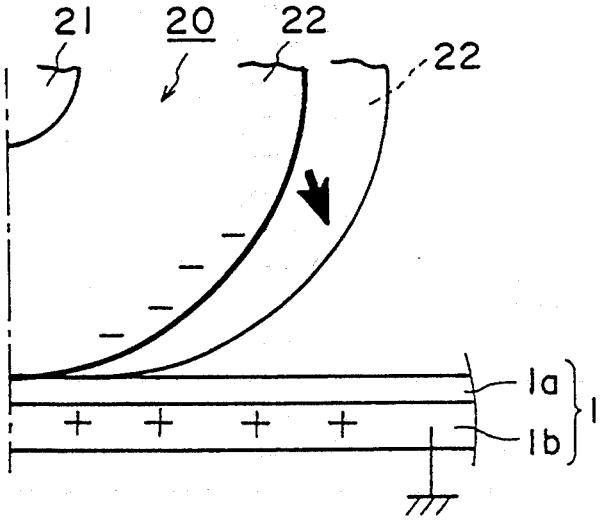

Referring to FIG. 10, there is shown an exemplary image forming apparatus using a contact type charging means of a AC application type described in the foregoing, as a means for charging an image bearing member. In this embodiment, the image forming apparatus is in the form of a laser beam printer using an electrophotographic process.

An image bearing member in the form of an electrophotographic photosensitive drum 1 (photosensitive drum) is rotated in a direction indicated by an arrow A at a predetermined peripheral speed (process speed 40 mm/sec, for example).

The contact type charging member is in the form of a charging roller 2 in this embodiment. The charging roller 2 extends substantially parallel to the photosensitive drum 1, and has a metal core 2*a*, which is supported at its longitudinal ends by bearings (not shown), and an outer layer 2*b*. The charging roller 2 is urged to the photosensitive drum 1 by a pressure spring 23, and is press-contacted to the surface of the photosensitive drum 1 with a predetermined pressure. In this example, it rotates following rotation of the photosensitive drum 1.

The charging roller 2 is supplied from a voltage source 4 through a sliding electrode 24 contacted to the metal core 2*a* with an oscillating voltage (Vac+Vdc) comprising an AC component having a peak-to-peak voltage which is not less than twice a charge starting voltage relative to the photosensitive member and an AC component having a voltage level corresponding to the target charging potential. By doing so, the peripheral surface of the rotating photosensitive drum 1 is uniformly charged by the contact type charging member of an AC application type.

The oscillating voltage comprises the AC component or the AC component and the DC component, and the waveform of the oscillating voltage is a sine wave, rectangular wave, triangular wave or the like. The oscillating voltage may be provided by periodically actuating and deactuating an AC voltage, thus providing a rectangular oscillating voltage.

Then, the charged surface of the rotating photosensitive drum 1 is exposed to a scanning laser beam 5 which is modulated and emitted in accordance with a time series of electric digital pixel signals bearing (image) information to be printed, by an unshown laser scanner. Thus, the information to be printed is written as an electrostatic latent image on the photosensitive member.

The latent image is visualized (developed) into a toner image through a reversal development using a developing sleeve 6 (developing device). The toner image is sequentially transferred onto a transfer material 7 supplied at a predetermined timing to a nip (image transfer nip) formed photosensitive drum 1 and the transfer roller 8. The transfer material 7 is supplied from an unshown sheet feeding station.

The transfer material 7 now having the transferred toner image is separated from the surface of the photosensitive drum 1, and is conveyed to an unshown image fixing means, where the toner image is fixed on the transfer material 7. The transfer material 7 is discharged as a print. The surface of the rotating photosensitive drum 1, after being subjected to the image transfer operation, is cleaned by a cleaning device (cleaner), more particularly, by the cleaning blade 9, so that the residual matter such as residual toner or the like is removed therefrom, and it is used for the repeated image formation.

An embodiment of the contact type charging device will be described in further detail.

Figure 1:
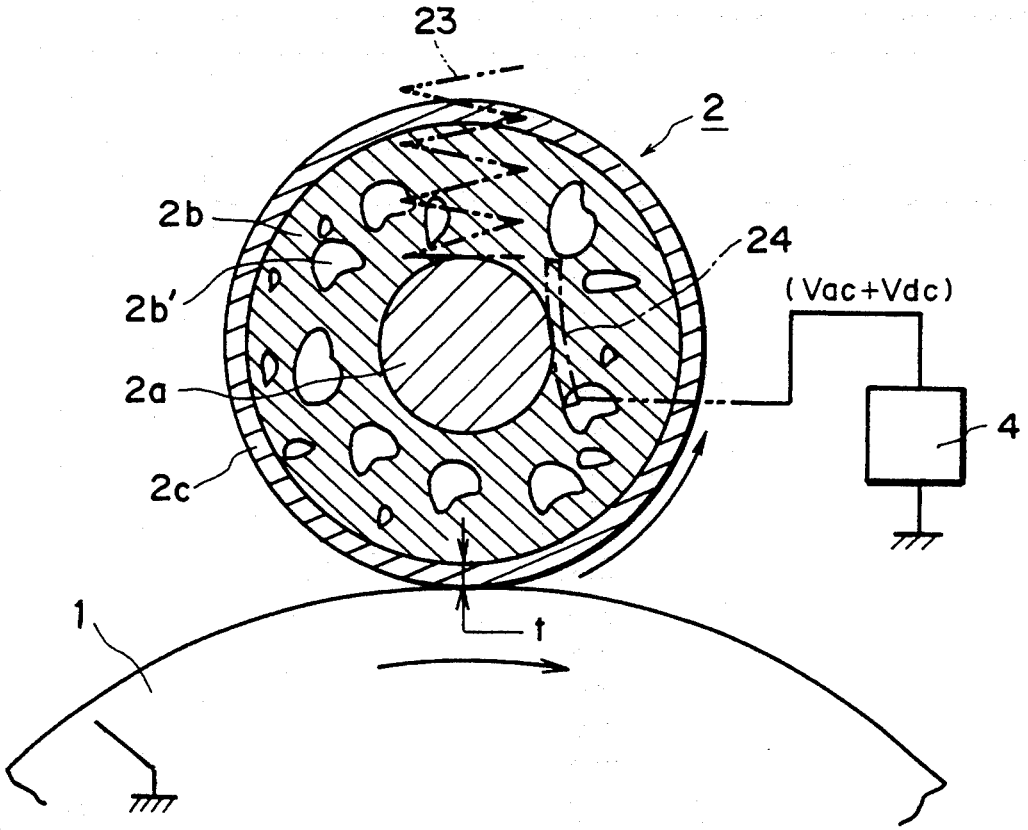
FIG. 1 is a sectional view of a contact type charging member (roller) or device according to a first embodiment of the present invention.
Figure 2:
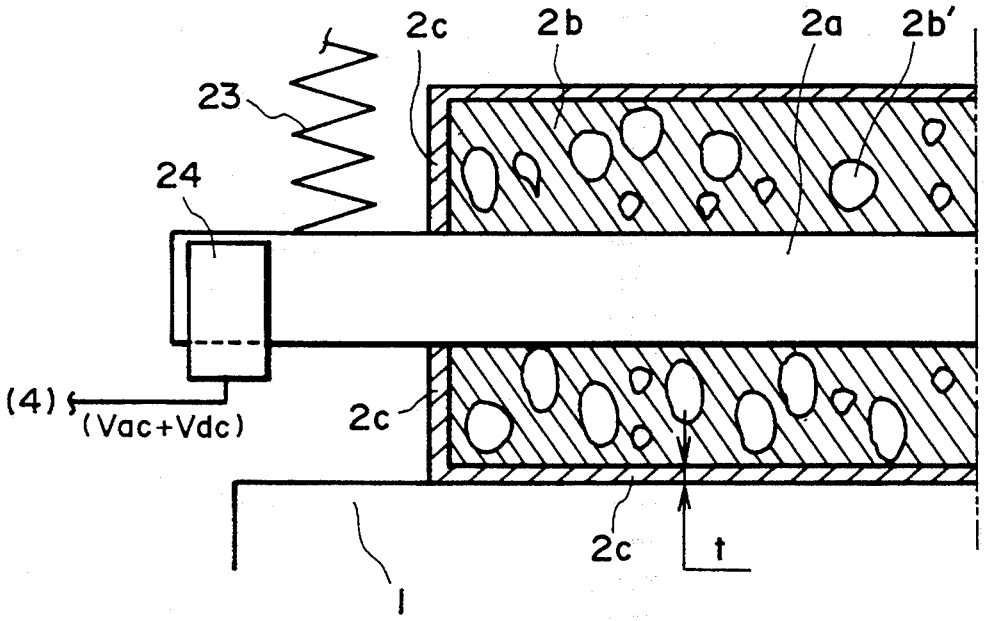
FIG. 2 is a longitudinal sectional view of an end portion of the device.

Referring to FIG. 1, there is shown a contact type charging device. FIG. 2 is a sectional view at an end of the charging member. The photosensitive drum 1 in this embodiment comprises a base member in the form of an aluminum drum and a photosensitive layer thereon. It has an outer diameter of 30 mm, weight of Wt=86.9 g (the entire weight of the photosensitive drum unit including the flange).

A contact type charging member 2 is in the form of a charging roller. It comprises a metal core 2*a* made of stainless steel or the like and functioning as a supporting member, a foamed layer thereon, and a charging layer 2*c* covering the outer peripheral surface and the end surfaces of the foamed material, thus constituting a three-layer structure.

The foamed material 2*b* is a soft and low density material such as foamed polystyrene, polyolefin, polyester, polyurethane or polyamide or the like, or foamed EPDM (tercopolymer of ethylene propylenediene) in which carbon, tin oxide or other conductive powder is dispersed. In this embodiment, it is a foamed polystyrene (foamed styrol). Reference character 2*b'* indicates foams (shield foam containing air, nitrogen or argon gas).

The charging layer 2*c* is a conductive rubber material layer of EPDM or the like in which carbon is dispersed, in this embodiment. In the Figure, t indicates a thickness of the charging layer 2*c*, and 5 microns <100,000 microns.

The foamed material 2*b* is not necessarily electrically conductive, if the outer conductive charging layer 2*c* extends to the end surface of the foamed material 2*b*, as shown in FIG. 2, to establish electric connection with the conductive core metal 2*a*.

The charging roller 2 has the following specification:

Core metal 2*a*: a circular rod of stainless steel having a diameter of 9 mm and a length of 332 mm.

Foamed material 2*b*: foamed styrol having a specific gravity of 0.3, a layer thickness of 13 mm and a length of 310 mm.

Charging layer 2*c*: EPDM conductive rubber layer in which carbon is dispersed and which has a volume resistivity of $10^5$ ohm.cm and a layer thickness t of 80 microns.

Weight Wc of the charging roller 2: 65 g.

End portions of the core metal 2*a* of the charging roller 2, are supported by unshown bearing members, and it is urged to the photosensitive drum 1 by a pressure spring 23 so that it is press-contacted to the surface of the photosensitive drum 1 with a predetermined pressure, more particularly, a total pressure of 300 g in this embodiment. With the rotation of the photosensitive drum 1, it rotates following the rotation thereof (it may be rotated in the same or opposite direction positively).

To the charging roller 2, an oscillating voltage comprising the following components is applied through a sliding electrode 24 contacted to the charging roller core metal 2*a*:

AC voltage component Vac: 2.0 kVpp, 600 Hz in this embodiment.

DC voltage component Vdc: a DC voltage corresponding to the target charging voltage.

Those voltages are superposed, and the superposed voltage (Vac+Vdc) is supplied. By doing so, the surface of the rotating photosensitive drum 1 is uniformly charged through the contact charging process of an AC application type to a target charge potential.

Here, if the peak-to-peak voltage Vpp of the AC component of the oscillating voltage (Vac+Vdc) applied to the contact charging member is reduced to less than twice the charge starting voltage relative to the member to be charged, the charging noise can be substantially improved. However, in the contact type charging of an AC application type, the reduction of the peak-to-peak voltage Vpp of the AC component means a reduction of the uniformization effect by the AC component application with the result of non-uniform or uneven charging, even to an extent of spot-like charge unevenness. In order to prevent this, it is preferable that the peak-to-peak voltage of the oscillating voltage applied to the charging member is not less than twice the charge starting voltage relative to the member to be charged. The charge starting voltage is a DC voltage applied to the charging member when the charging action occurs to the member to be charged.

(1) The material outside the metal core 2*a* of the charging roller 2 includes a foamed member 2*b* and a thin charging layer 2*b*. This charging roller is lighter than the conventional solid charging roller, and the hardness thereof is lower than the conventional one. The following is an example of a conventional solid roller:

Metal core: a stainless steel rod having a diameter of 2 mm and a length of 332 mm.

Charging layer: solid EPDM conductive rubber in which carbon is dispersed, having a specific gravity of 1.0, volume resistivity $10^5$ ohm/cm, a layer thickness of 2.5 mm and a length of 310 mm.

Weight Wc of the charging roller: 130.4 g.

The contact charging device of this embodiment is placed in an anechoic chamber, and the charging noise was measured when the above-described oscillating voltage was applied. The measurements were carried out in accordance with paragraph 6 of ISO 7779. The detected noise was as small as 33 dB.

The charging noise of the integral and solid type conventional charging roller was measured through the same measuring method, and the measured noise was 63.0 dB.

(2) The relationship between the frequency of the oscillating voltage applied between the charging roller 2 and the photosensitive drum 1 and the charging noise, was investigated in the following manner.

Figure 3:
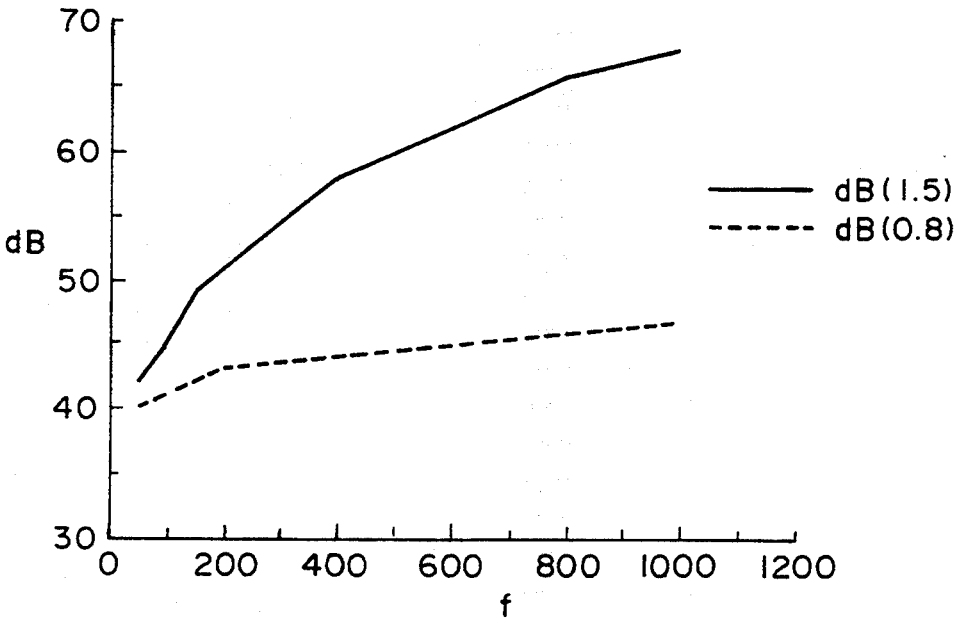
FIG. 3 is a graph of noise level (dB) vs. frequency f.

FIG. 3 shows results of the investigations. The ordinate represents the charging noise, and the abscissa represents the frequency. The solid line represents in the case of Wc/Wd=1.5, where Wc is the weight, and Wd is a weight of the photosensitive drum. The broken line represents the case of Wc/Wd=0.8.

As will be understood from this Figure, in the case of the conventional charging roller indicated by the solid line, the charging noise exceeds 50 dB when the frequency of the applied bias voltage increases 200 Hz, and the charging noise increases with an increase of the frequency. On the contrary, in the case of the present embodiment indicated by the broken line, the charging noise increases with increase of the frequency, but the charging noise does not exceed 50 dB.

Therefore, it is understood that the charging noise decreases with decrease of the weight of the charging roller relative to the weight Wd of the photosensitive drum.

(3) The relationship among the weight of the charging roller 2, the weight of the photosensitive drum 1 and the produced charging noise, in the following manner.

The charging roller 2 weight Wc was changed by changing the outer diameter and the longitudinal length of the core metal 2*a* of the charging roller 2. In order to maintain a constant nip formed between the charging roller and the photosensitive drum 1, the thickness of the charging layer 2*c* plus the foamed member 2*b* is maintained constant even if the outer diameter of the metal core 2*a* is changed.

The weight Wd of the photosensitive drum was changed by changing the outer diameter of the photosensitive drum and a thickness of the aluminum drum base. The weight of the photosensitive drum is the weight including the flange portions, that is, the weight of the entire photosensitive drum unit.

Figure 4:
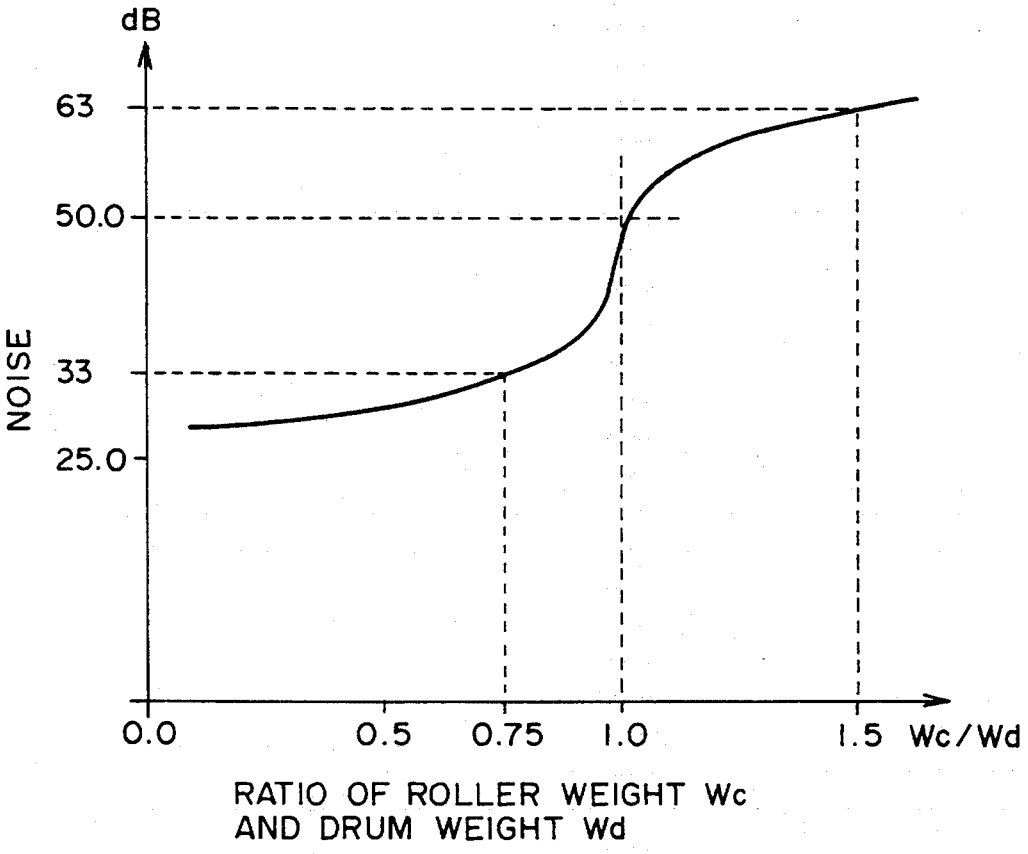
FIG. 4 is a graph of noise level (dB) vs. ratio Wc/Wd of weight of a charging roller to weight of a photosensitive drum.

FIG. 4 shows results of the investigations. In this graph, the ordinate represents the charging noise measured when the above oscillating voltage was applied to the charging roller 2, and the abscissa represents the ratio of the charging roller 2 weight Wc to the photosensitive drum weight Wd.

In this embodiment, as described hereinbefore, the weights were as follows:

Charging roller 2 (Wc)=65 g

Photosensitive drum 1 (Wd)=86.9 g

Therefore, Wc/Wd was 0.75, and the produced charging noise was approx. 33 dB.

The weight Wc of the conventional solid charging roller 22 was 130.4 g, and the ratio Wc/Wd was 1.50 (Wd=86.9), and the charging noise was 63.0 dB.

As will be understood from the graph of FIG. 4, it is understood that the charging noise steeply decreases when the ratio Wc/Wd decreases beyond 1.0.

Therefore, in order to suppress the charging noise, it is preferable that Wc/Wd<1.0, since then the charging noise is not significant (not more than 50 dB, for example).

As for a method of reducing the weight ratio. Wc/Wd beyond 1.0, the weight of the charging roller 2 is reduced, and in addition, the weight of the photosensitive drum 1 may be increased. Even when the conventional solid charging roller having the weight of 130.4 g is used, the same advantageous effects are provided if the photosensitive drum 1 is filled with clay or rubber, thus increasing the weight Wd of the photosensitive drum to satisfy Wc/Wd<1.0.

More particularly, approx. 87 g of clay is filled in the photosensitive drum having the weight of 86.9 g of this embodiment to increase the weight Wd of the photosensitive drum 1 to 174.0 g. Then, the weight ratio Wc/Wd is 130.4/174.0=0.75.

As a result, the charging noise of approx. 33 dB was measured through the same measuring method.

(4) The investigations have been made as to the relationship among the frequency of the oscillating voltage applied between the charging roller 2 and the photosensitive drum 1, the process speed, and the toner fusing on the photosensitive drum 1, in the following manner.

Figure 5:
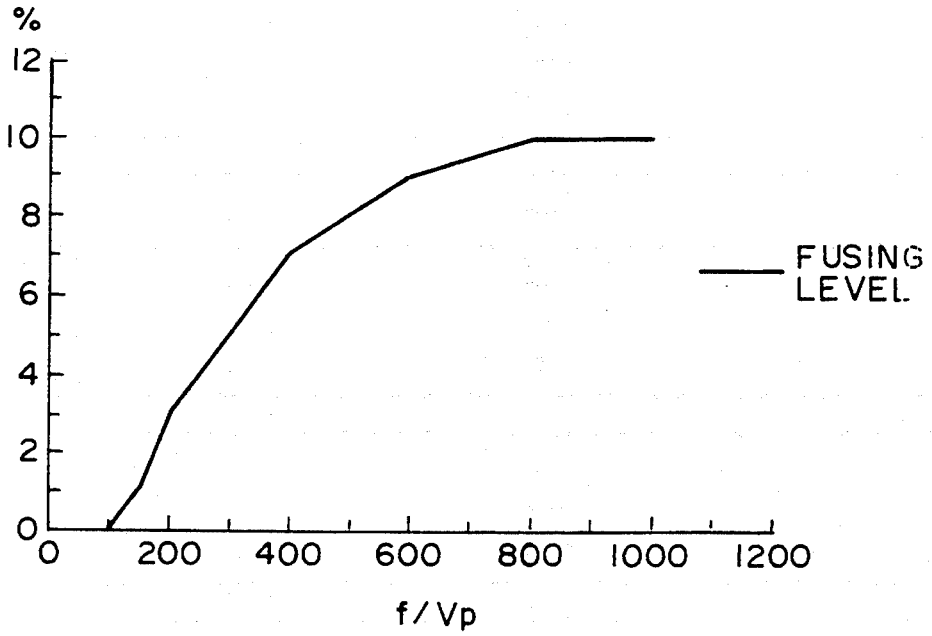
FIG. 5 is a graph showing relations among process speed, frequency of charge bias and toner fusing.

FIG. 5 shows a relation between rate of occurrence of the toner fusing and the frequency (f) of the applied voltage and the process speed (Vp). The rate of occurrence of the-toner fusing is the rate of occurrence of the improper images due to the toner fusing, when A4 size transfer materials are subjected to the image printing operation. The abscissa represents f/Vp, which is equal to F/2Vp (F: oscillating frequency of the charging member). Therefore, it is the number of beatings of the charging roller to a unit circumferential length of the photosensitive drum surface.

As will be understood from this figure, improper image formation due to the toner fusing occurs when f/Vp exceeds approx. 100.

(5) The charging layer 2c has an inside foamed material member 2b, the shape thereof is properly maintained even though the thickness thereof is small (not less than 5 microns). Therefore, even if the charging roller 2 is urged to the photosensitive drum 1, the possible local separation from the photosensitive drum 1 surface, does not occur, and therefore, it is press-contacted to the surface of the photosensitive drum over the entire length. Therefore, even if the length of the charging roller 2 is increased, no problem due to the improper close-contact does not occur. If it occurs, the insufficient charging appears corresponding to the rotational period of the charging roller.

(6) The fact that the charging noise can be reduced means that the frequency of the AC component of the applied oscillating voltage to the contact charging member can be increased. Then, it is possible to solve a problem of "moire" arising when the frequency is low. This problem occurs due to the moire interference fringe due to the interference between the scanning laser beam and the charge unevenness due to the frequency of the AC component.

(7) The bearing force of the charging roller 2 (contact charging member) to the photosensitive drum 1 is reduced, and the number of beatings is limited. Therefore, the toner fusing due to the toner not removed by the cleaning operation being pressed on the surface of the photosensitive drum 1, can be suppressed.

Embodiment 2

Figure 6:
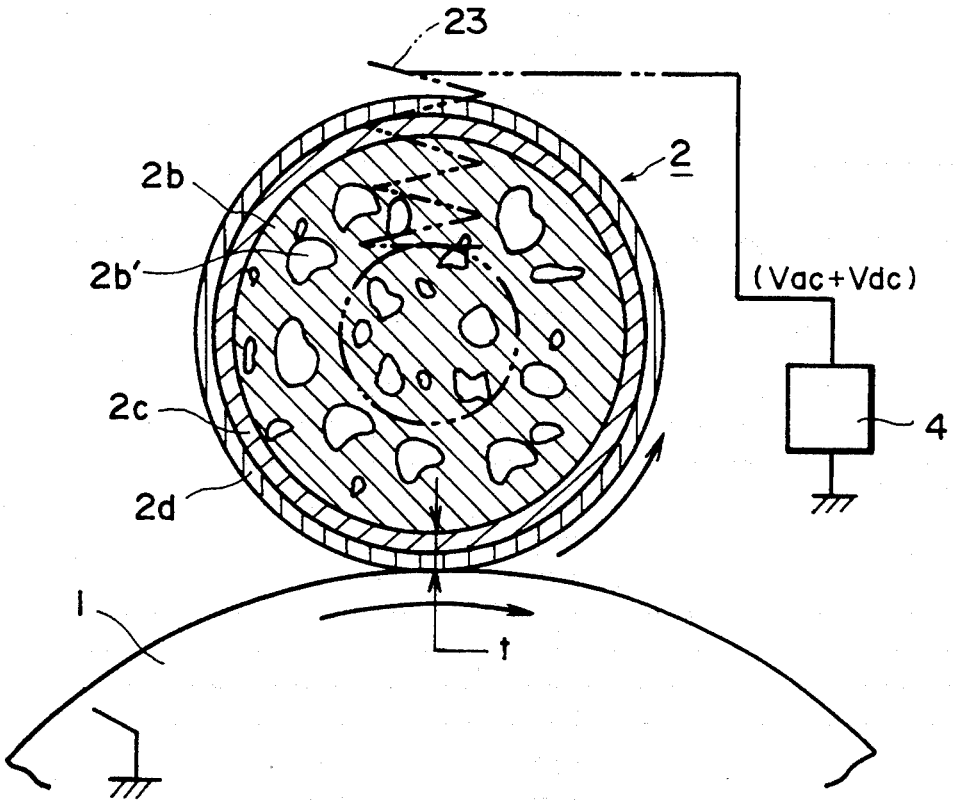
FIG. 6 is a sectional view of a contact type charging member (roller) or device according to a second embodiment of the present invention.
Figure 7:
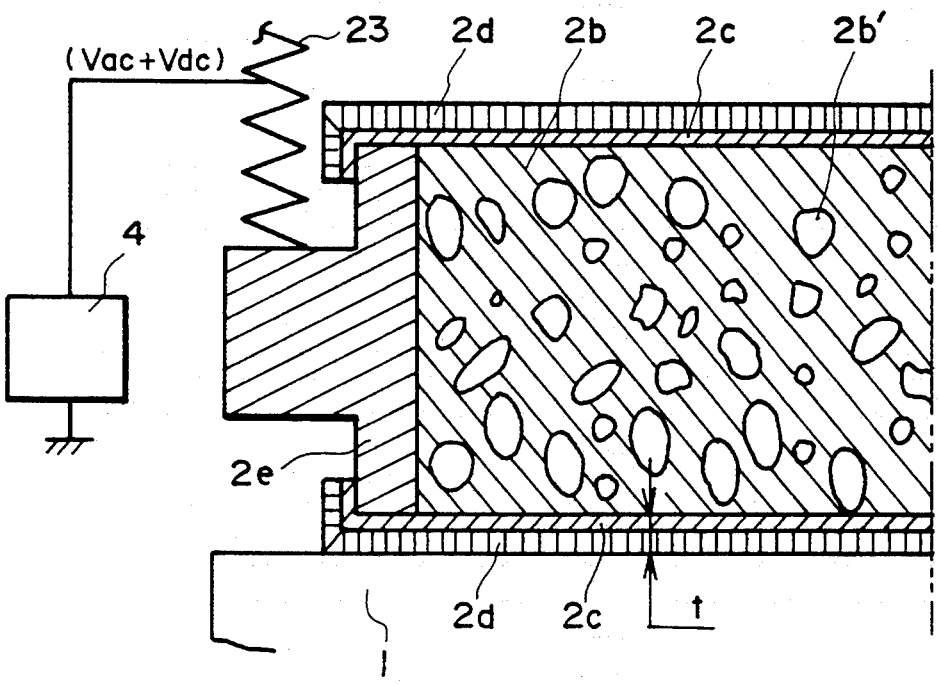
FIG. 7 is a longitudinal sectional view of an end portion of the device.

Referring to FIGS. 6 and 7, a charging member according to another embodiment of the present invention will be described. In the present embodiment, a high resistance layer 2d made of epichlorohydrin rubber or paper is provided to the outer circumferential of the charging layer 2c of the charging roller 2. In this embodiment, the foamed member 2b is made of foamed styrol in the foam of a roller. To the longitudinal ends thereof, metal flanges 2e having shaft portions are bonded as supporting members. The charging layer 2c is formed over the outer peripheral surface of the foamed member 2b in the form of a roller and metal flanges 2e at the opposite longitudinal ends. In addition, a high resistance layer 2d is provided on the outer periphery thereof. The high resistance layer 2d has a volume resistivity which is larger than that of the charging layer 2c.

The specifications of the charging roller 2 in this embodiment are as follows:

Foamed member 2b: foamed styrol resin having a specific gravity of 0.3, a diameter of 13 mm and a length of 310 mm.

Charging layer 2c: electrically conductive EPDM rubber layer in which carbon is dispersed, and having a volume resistivity of $10^5$ ohm/cm and a layer thickness of 80 microns.

High resistance layer 2d: epichlorohydrin rubber having a volume resistivity of $10^{10}$ ohm/cm and a layer thickness of 80 microns.

Weight (Wc) of the charging roller 2: 50 g.

The shaft portions of the opposite flanges 2e of the charging roller 2 are supported by unshown bearings, and the charging roller 2 is urged to the photosensitive drum 1 by pressure spring 23 to press-contact it to the surface of the photosensitive drum 1 with a total pressure of 300 g. It rotates following the rotation of the photosensitive drum 1.

The charging roller 2 is supplied with an oscillating voltage (Vac+Vdc) similar to that in the first embodiment through pressure springs 23 and metal flanges 2e, from the voltage source. The applied bias voltage is supplied to the charging layer 2c to which the metal flanges 2e are electrically connected. The high resistance layer 2d is effective, when the charging roller is contacted to low durable voltage portion (defect) (such as pin hole) on the photosensitive drum 1, to prevent concentrated leakage of the current to the pin hole with the result of non-transfer stripe occurred.

In this embodiment, the weight ratio of the charging roller 2 to the photosensitive drum 1 is:

$$Wc/Wd=50\ g/86.9\ g=0.58$$

The result of measurement of the charging noise was as small as 30 dB, when the same oscillating voltage is applied and when the same measurement method as in the first embodiment was used.

In this embodiment, the supporting member of the charging roller 2 is not in the form of a metal core 2*a* penetrating through the entire length of the roller as in the first embodiment. It is in the form of flange members 2*e* at the longitudinally opposite ends, and therefore, the charging roller is light and the cost is reduced.

It is possible to coat the high resistance layer 2*d* further with a seepage preventing layer made of nylon or the like to prevent plasticizer from seeping out of the inside of the charging roller to contaminate the photosensitive drum 1.

Embodiment 3

Figure 8:
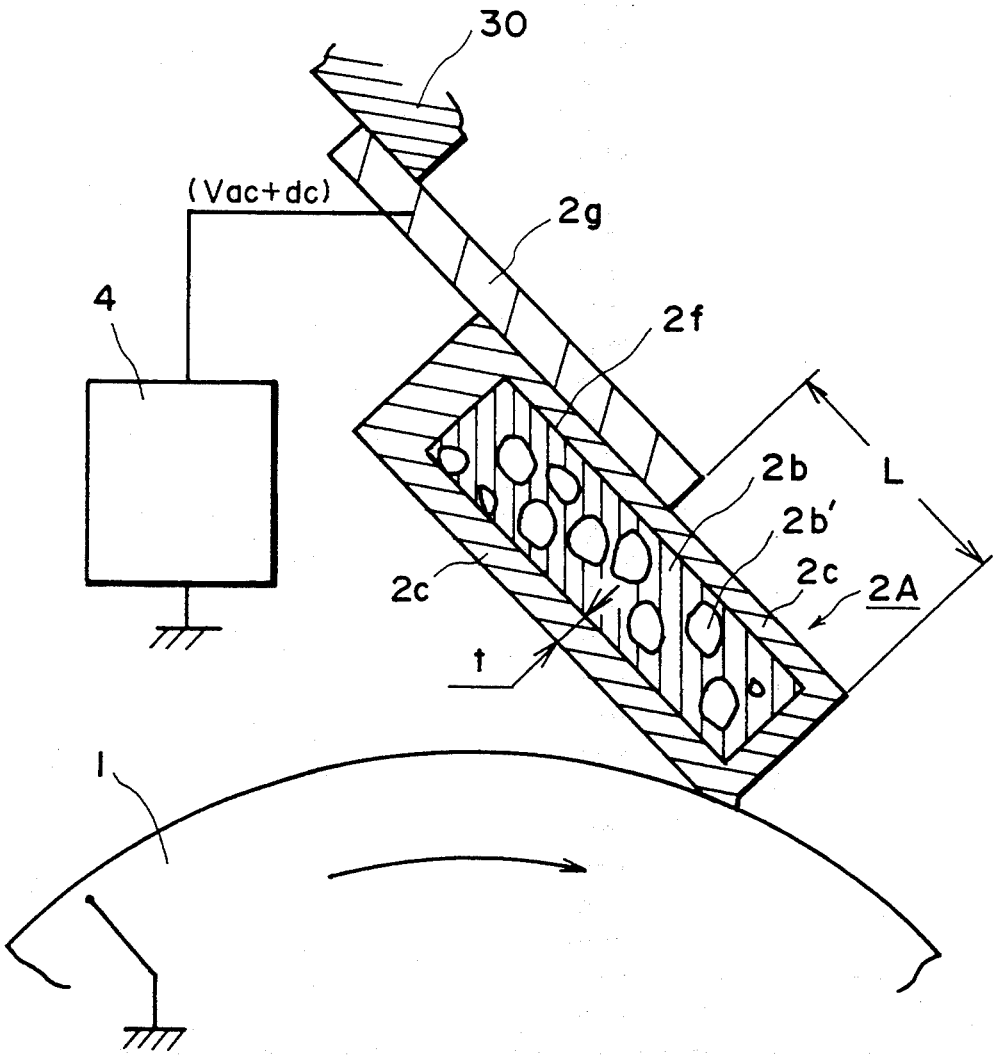
FIG. 8 is a sectional view of a contact type charging member (roller) or device according to a third embodiment of the present invention.

FIG. 8 shows a charging member according to a further embodiment of the present invention. In the present embodiment, the contact charging member is in the form of a blade (charging blade), and FIG. 8 is a sectional view of a contact type charging device in the form of a charging blade 2A. The contact type charging device using the charging blade 2A is more simple in the structure than the charging roller.

The charging blade 2A comprises a foamed member (core member) 2*b* of foamed polypropylene, a charging layer 2*c*, on the outer peripheral surface of the foamed member 2*b*, which is made of EPDM or polyurethane or the like resin material in which carbon or tin oxide or another conductive power is dispersed, and an electrode 2*g* functioning as a supporting member for supporting them through electrically conductive bonding agent 2*f*.

The edge of the charging blade 2*a* is press-contacted to the surface of the photosensitive drum 1 with proper pressure-contact force against the elasticity of the blade, and the electrode plate 2*g* functioning as the supporting member is securedly fixed on a fixed member 30, thus the charging blade 2 is properly disposed and mounted.

The charging blade 2*a* is supplied with an oscillating voltage (Vac+Vdc) from a voltage source 4 through the supporting member 2*g* (electrode plate). It uniformly charges the surface of the rotating photosensitive drum 1 through a contact type charging process of an AC application type.

In this embodiment, when the charging blade 2*a* of the following specifications is used, the blade weight was 82 g; drum weight was 86.9 g; and therefore, Wc/Wd was 0.95. The charging noise was 40 dB (the applied oscillating voltage was the same as in Embodiment 1).

The foamed material 2*b*: foamed polypropylene resin having a specific gravity of 0.3, a width of 10 mm, a length of 310 mm and the thickness of 3 mm.

Charging layer 2*c*: electrically conductive EPDM rubber layer in which carbon is dispersed, having a volume resistivity of $10^{10}$ ohm/cm, a layer thickness t of 500 microns, a free length L of the charging blade 2*a* of 5 mm, and a total urging pressure to the photosensitive drum 1 of 700 g.

Therefore, the charging noise could be reduced in the case of the charging blade 2*a*. In this embodiment, it is advantageous that the urging pressure of the charging blade 2*a* to the photosensitive drum 1 can be controlled using the flexibility or elasticity of the blade.

Figure 9:
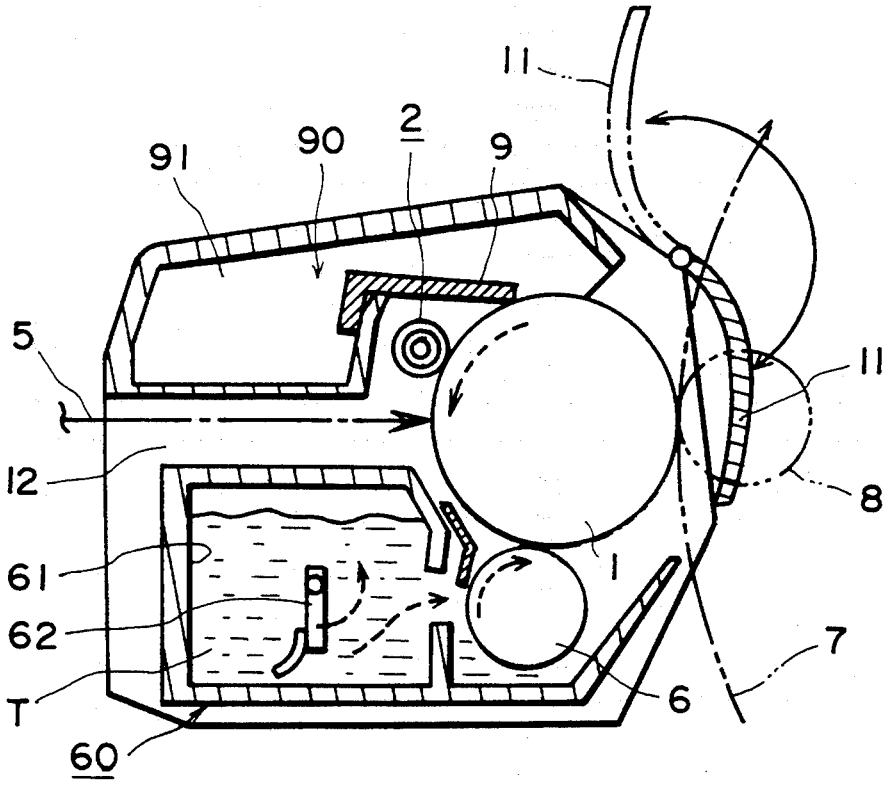
FIG. 9 is a sectional view of a process cartridge.

Referring to FIG. 9, there is shown a process cartridge detachably mountable to an image forming apparatus, provided with the charging member.

This embodiment is directed to a process cartridge for an image forming apparatus, in which the contact type charging member or device according to this invention is used as the means for electrically charging the image bearing member.

The process cartridge of this embodiment comprises an image bearing member in the form of a rotatable electrophotographic photosensitive drum, a contact charging member in the form of a charging roller 2, a developing device 60 and a cleaning device 90. Thus, it comprises four process means. The process cartridge of this embodiment is not limited to those containing the four process means. Any combination is possible.

The charging roller 2 is made in accordance with the first or second embodiment of this invention.

The developing device 60 comprises a developing sleeve 6, a toner container 61 for containing a developer (toner) T and a toner stirring rod 62 for stirring the toner in the container 61. The toner stirring rod is also effective to feed the toner T toward the developing sleeve. A developing blade 63 functions to apply the toner T on the developing sleeve 6 in a uniform thickness.

The cleaning device 90 comprises a cleaning blade 9 and a residual toner container 91 for containing the toner particles removed by the cleaning blade 9.

A drum shutter 11 for the process cartridge is movable between a solid line closed state to a chain line open state. In the state in which the process cartridge is taken out of the image forming apparatus (not shown), the shutter is in the close position to protect the surface of the photosensitive drum by covering the exposed surface of the photosensitive drum 1.

When the process cartridge is mounted to the main assembly of the image forming apparatus, the shutter 11 is opened as indicated by chain lines. Or, during the process of mounting the process cartridge, the shutter 11 is automatically opened, and when the process cartridge is mounted in place, the exposed surface of the photosensitive drum 1 is press-contacted to the transfer roller 8 provided in the main assembly of the image forming apparatus.

The process cartridge and the main assembly of the image forming apparatus, are mechanically and electrically coupled to permit driving of the photosensitive drum 1, the developing sleeve 6, the stirring rod 62 or the like in the process cartridge by the driving mechanism which is provided in the image forming apparatus. Also, the charging bias application to the charging roller 2, and the developing bias voltage application to the developing sleeve 6 or the like are permitted from the electric circuit which is provided in the main assembly of the image forming apparatus, and therefore, the image forming operation is enabled. An image exposure light path 12 is provided between the cleaning device 90 of the process cartridge and the developing device 60, and the output laser beam 5 from the laser scanner (not shown) of the main assembly of the image forming apparatus enters the process cartridge through the optical path 12 and is projected on the rotating surface of the photosensitive drum 1.

Since the charging roller 2 produces substantially no noise even if the oscillating voltage is applied thereto, the process cartridge can be very compact substantially without production of the charging noise.

As will be understood from the foregoing, the charging noise is decreased with a decrease of the weight ratio of the member to be charged and the charging member Wc/Wd. By selecting the weight ratio to satisfy $Wc/Wd<1.0$, the charging noise can be reduced to a level of practically no problem.

The fact that the charging noise can be reduced means that the frequency of the AC component of the applied oscillating voltage to the contact type charging member can be increased, and therefore, the production of the moire interference fringe on the image can be prevented, which is otherwise caused due to the interference between the scanning laser beam and the charging unevenness due to the frequency of the AC component.

By satisfying $Vp>f/100$ in the image forming apparatus, the beating of the contact type charging member to the member to be charged is reduced, and the number of beating is limited, and therefore, the toner fusing resulting from pressure to the toner to the member to be charged, can be prevented.

While the invention has been described with reference to the structures disclosed herein, it is not confined to the details set forth and this application is intended to cover such modifications or changes as may come within the purposes of the improvements or the scope of the following claims.

What is claimed is:

1. A charging device for transferring an oscillating voltage from a voltage source, said charging device comprising:

a movable member to be charged;

a charging member contactable to said member to be charged to electrically charge said member to be charged, said charging member being configured to receive the oscillating voltage and to conduct the oscillating voltage to said member to be charged;

wherein $Wc/Wd<1.0$ is satisfied, where Wc is a weight of said charging member, and Wd is a weight of said member to be charged; and wherein $Vp>f/100$ (mm/sec) when said charging member conducts the oscillating voltage to said member to be charged, where Vp (mm/sec) is a moving speed of the member to be charged, and f (Hz) is a frequency of the oscillating voltage.

2. A device according to claim 1, wherein said oscillating voltage is an AC biased DC voltage.

3. A device according to claim 1 or 2, wherein a peak-to-peak voltage of the oscillating voltage is not less than twice a charge starting voltage relative to said member to be charged.

4. A device according to claim 1, wherein said charging member a roller.

5. A device according to claim 1, wherein said charging member a blade.

6. A device according to claim 1, wherein said charging member comprises a sponge layer.

7. A process cartridge detachably mountable to an image forming apparatus, the apparatus including a voltage application means for applying an oscillating voltage, said process cartridge comprising:

a movable member to be charged, said member to be charged being an image-bearing member;

a charging member contactable to said member to be charged to electrically charge said member to be charged, wherein an oscillating voltage is applied between said charging member and said member to be charged by the voltage application means;

wherein $Wc/Wd<1.0$ is satisfied, where Wc is a weight of said charging member, and Wd is a weight of said member to be charged; and wherein $Vp>f/100$ (mm/sec) when said member to be charged is charged by said charging member, where Vp (mm/sec) is a moving speed of the member to be charged, and f (Hz) is a frequency of the oscillating voltage.

8. A process cartridge according to claim 7, further comprising developing means for developing a latent image on said image bearing member.

9. An image forming apparatus, comprising:

a movable member to be charged, said member to be charged being an image bearing member;

a charging member contactable to said member to be charged to electrically charge said member to be charged;

a voltage application means for applying an oscillating voltage between said charging member and said member to be charged;

wherein $Wc/Wd\leqq1.0$ is satisfied, where Wc is a weight of said charging member, and Wd is a weight of said member to be charged; and wherein $Vp>f/100$ (mm/sec) when said member to be charged is charged by said charging member, where Vp (mm/sec) is a moving speed of the member to be charged, and f (Hz) is a frequency of the oscillating voltage.

10. An apparatus according to claim 9, wherein said oscillating voltage is an AC biased DC voltage.

11. An apparatus according to claim 9 or 10, wherein a peak-to-peak voltage of the oscillating voltage is not less than twice a charge starting voltage relative to said member to be charged.

12. An apparatus according to claim 9, wherein said charging member is in the form of a roller.

13. An apparatus according to claim 9, wherein said charging member is in the form of a blade.

14. An apparatus according to claim 9, wherein said charging member comprises a sponge layer.

15. An apparatus according to claim 9, wherein said member to be charged is in the form of a photosensitive member.

16. A charging device according to claim 1, wherein there is provided a weight in said member to be charged.

17. A process cartridge according to claim 7, wherein said charging member comprises a roller.

18. A process cartridge according to claim 7, wherein said charging member comprises a blade.

19. A process cartridge according to claim 7, wherein said charging member comprises a sponge layer.

20. A process cartridge according to claim 7, wherein there is provided a weight in said member to be charged.

21. An apparatus according to claim 9, wherein there is provided a weight in said member to be charged.

* * * * *

UNITED STATES PATENT AND TRADEMARK OFFICE

CERTIFICATE OF CORRECTION

PATENT NO. : 5,440,374

DATED : August 8, 1995

INVENTOR(S) : HIROKI KISU

It is certified that error appears in the above-indentified patent and that said Letters Patent is hereby corrected as shown below:

ON THE COVER PAGE

[30] Foreign Application Priority Data

"164225" should read --4-164225--.

[56] FOREIGN PATENT DOCUMENTS

"417801 3/1991 Japan" should be deleted.

[57] ABSTRACT

Line 4, "of" should read --for--.
Line 11, "voltage." should read --voltage. By satisfying above the eight ratio relationship and the moving speed relationship, a charging noise caused by the application of the oscillating voltage is reduced.--.

COLUMN 6

Line 60, "in" should read --were investigated in--.
Line 63, "core metal 2a" should read --metal core 2a--.

COLUMN 7

Line 29, "ratio." should read --ratio--.
Line 53, "the-toner" should read --the toner--.

UNITED STATES PATENT AND TRADEMARK OFFICE

CERTIFICATE OF CORRECTION

PATENT NO. : 5,440,374 Page 2 of 2

DATED : August 8, 1995

INVENTOR(S) : HIROKI KISU

It is certified that error appears in the above-indentified patent and that said Letters Patent is hereby corrected as shown below:

COLUMN 8

Line 6, "does not occur." should read --occurs.--.
Line 30, "circumferential" should read --circumferential surface--.

COLUMN 11

Line 62, "a" should read --comprises a--.
Line 64, "a" should read --comprises a--.

Signed and Sealed this

Twelfth Day of December, 1995

*Attest:*

*Attesting Officer*

Bruce Lehman

BRUCE LEHMAN

*Commissioner of Patents and Trademarks*